US012372333B2

(12) United States Patent
Milo

(10) Patent No.: US 12,372,333 B2
(45) Date of Patent: Jul. 29, 2025

(54) INFLATABLE BALLISTIC SHIELD DEVICE

(71) Applicant: Tom Milo, Cuyahoga Falls, OH (US)

(72) Inventor: Tom Milo, Cuyahoga Falls, OH (US)

( * ) Notice: Subject to any disclaimer, the term of this patent is extended or adjusted under 35 U.S.C. 154(b) by 0 days.

(21) Appl. No.: 18/415,916

(22) Filed: Jan. 18, 2024

(65) Prior Publication Data

US 2024/0393087 A1 Nov. 28, 2024

Related U.S. Application Data

(60) Provisional application No. 63/439,665, filed on Jan. 18, 2023.

(51) Int. Cl.
*F41H 5/08* (2006.01)
*F41H 5/04* (2006.01)

(52) U.S. Cl.
CPC ..... *F41H 5/0471* (2013.01); *F41H 5/08* (2013.01)

(58) Field of Classification Search
CPC ..... F41H 5/08
See application file for complete search history.

(56) References Cited

U.S. PATENT DOCUMENTS 3,745,938 A * 7/1973 Hathaway ..... F41H 5/08 2/2.5
2019/0145740 A1* 5/2019 Czerski ..... B32B 5/02 2/463
2021/0270574 A1* 9/2021 Bopp ..... F41H 5/0471

* cited by examiner

*Primary Examiner* — J. Woodrow Eldred
(74) *Attorney, Agent, or Firm* — Brennan, Manna & Diamond, LLC

(57) ABSTRACT

An inflatable ballistic shield device is provided. The device is preferably comprised of at least three ballistic panels and an inflatable bladder. When not in use, the device can be stored in an uninflated, folded configuration. When in use, the bladder can be rapidly inflated, which unfolds the ballistic panels and forms the device into a rigid ballistic shield.

14 Claims, 8 Drawing Sheets

INFLATABLE BALLISTIC SHIELD DEVICE

CROSS-REFERENCE TO RELATED APPLICATION

The present application claims priority to, and the benefit of, U.S. Provisional Application No. 63/439,665, which was filed on Jan. 18, 2023, and is incorporated herein by reference in its entirety.

FIELD OF THE INVENTION

The present invention relates generally to the field of ballistic shields. More specifically, the present invention relates to an inflatable ballistic shield device that can be stored in an uninflated, folded configuration and then rapidly inflated and deployed. Accordingly, the present disclosure makes specific reference thereto. Nonetheless, it is to be appreciated that aspects of the present invention are also equally applicable to other like applications, devices, and methods of manufacture.

BACKGROUND

Existing ballistic shields known in the art are rigid and as a result, are cumbersome in size. Due to this rigidity, individuals may be unable to use ballistic shields in desired areas. Further, said individuals may lack the ability to store ballistic shields in desired areas.

Therefore, there exists a long-felt need in the art for an improved ballistic shield. There also exists a long-felt need in the art for an inflatable ballistic shield device that can easily be stored in a small space. In addition, there exists a long-felt need in the art for an inflatable ballistic shield device that can be easily carried when in a stored position. Further, there exists a long-felt need in the art for an inflatable ballistic shield device that is lighter than existing ballistic shields. Finally, there exists a long-felt need in the art for an improved ballistic shield that better distributes the impact of bullet strikes on the shields than existing ballistic shields known in the art.

The subject matter disclosed and claimed herein, in one embodiment thereof, comprises an inflatable ballistic shield device. The device is preferably comprised of at least three ballistic panels and an inflatable bladder. When not in use, the device can be stored in an uninflated, folded configuration. When in use, the bladder can be rapidly inflated, which unfolds the ballistic panels and forms the device into a rigid ballistic shield.

In this manner, the inflatable ballistic shield device of the present invention accomplishes all the forgoing objectives and provides an improved ballistic shield that can easily be stored in a small space and that can be easily carried when in a stored position. Further, the device is lighter than existing ballistic shields. In addition, the device better distributes the impact of bullet strikes on the shield than existing ballistic shields known in the art.

SUMMARY

The following presents a simplified summary to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises an inflatable ballistic shield device. The device is comprised of an inflatable ballistic shield with at least one inflatable bladder and at least one shield ballistic insert. During use, the device can be stored in an uninflated and folded state. Then, the device can be rapidly inflated and unfolded (either manually or automatically via the inflation of the bladder) before deployment to form a ballistic shield.

The device is comprised of a body made from a fabric material. The body may be any shape and size that can preferably cover (but is not limited to) the upper body (and in one embodiment, the pelvic area) of a user. At least one bladder is located within the body and is constructed using a plurality of tensile filaments/fibers. Once inflated, the filaments/fibers are placed in tension to ensure that the bladder will only be displaced in a limited and controlled manner when impacted with a projectile, and absorbs the force of the projectile impact and distributes the force of a projectile impact through the entire bladder.

In one embodiment, the bladder can be manually inflated and deflated with air via at least one valve. In another embodiment, the bladder can be inflated via at least one canister that preferably contains a gas, such as but not limited to CO2.

During the rapid inflation process, the body unfolds and then can be attached to a user via at least one arm strap located on the rear surface of the body. The strap is comprised of at least one fastener that allows the strap to be tightened around a user's arm. It should be noted that once fastened around a user's arm, the user's arm contacts the rear surface, in contrast to existing ballistic shields wherein a user's arm is often cantilevered relative to the shield while in use. In this manner, the device moves more like an extension of the user's body.

The body is also comprised of at least one shield ballistic insert that may be located within the body and/or may be stitched to or enclosed by the body (in a manner such that the panel is separated from the bladder) in front of the bladder (i.e., positioned such that the panel is the first structure of the device to absorb a projectile impact). In the preferred embodiment, the device has three shield ballistic inserts, which includes a large central panel, a top panel, and a bottom panel. In this embodiment, all or some of any area of the central panel may overlap any area of the top and bottom panels for additional strength and to prevent puncturing of the bladder.

In this embodiment, the top panel and bottom panel are each connected to the central panel via at least one fabric joint of the body. The configuration of the joint ensures that a portion of the central panel overlaps a portion of the top panel and bottom panel when the bladder is fully inflated. However, when the bladder is not inflated, the joint reverses and expands/moves upward, which allows the top panel and bottom panel to fold over the central panel. Because each panel is individually connected to the body via at least one stitch or other fastening method, inflation of the bladder facilitates the unfolding of the panels in the overlapping manner as seen. Similarly, the individual attachment of each panel to the body and the attachment of each joint ensures the top and bottom panels fold over the central panel when the bladder is not inflated or is uninflated. As a result, a user need not unfold the device during use and can rely on the inflation of the bladder and attachment of the panels to the body (and each other via the joint) to ensure proper folding/ unfolding. Furthermore, when in an uninflated and folded state the device forms a square-like shape that can be easily stored.

Accordingly, the inflatable ballistic shield device of the present invention is particularly advantageous as it provides an improved ballistic shield that can easily be stored in a small space and that can be easily carried when in a stored position. Further, the device is lighter than existing ballistic shields. In addition, the device better distributes the impact of bullet strikes on the shield than existing ballistic shields known in the art. In this manner, the inflatable ballistic shield device overcomes the limitations of existing ballistic shields known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
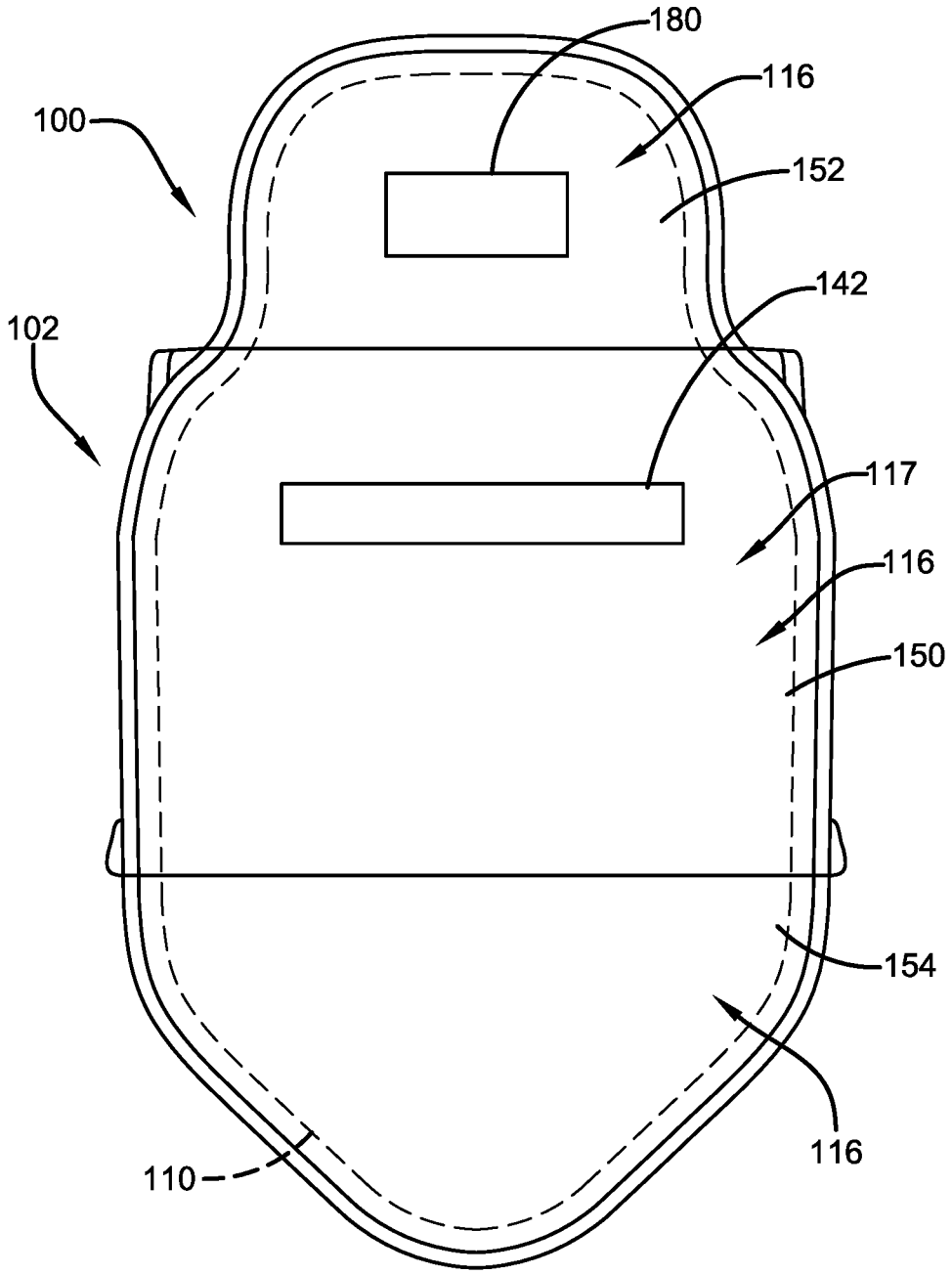
FIG. 1 illustrates a front view of one potential embodiment of an inflatable ballistic shield device of the present invention while inflated in accordance with the disclosed architecture.

The innovation is now described with reference to the drawings, wherein like reference numerals are used to refer to like elements throughout. In the following description, for purposes of explanation, numerous specific details are set forth to provide a thorough understanding thereof. It may be evident, however, that the innovation can be practiced without these specific details. In other instances, well-known structures and devices are shown in block diagram form to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for an improved ballistic shield. There also exists a long-felt need in the art for an inflatable ballistic shield device that can easily be stored in a small space. In addition, there exists a long-felt need in the art for an inflatable ballistic shield device that can be easily carried when in a stored position. Further, there exists a long-felt need in the art for an inflatable ballistic shield device that is lighter than existing ballistic shields. Finally, there exists a long-felt need in the art for an improved ballistic shield that better distributes the impact of bullet strikes on the shields than existing ballistic shields known in the art.

The present invention, in one exemplary embodiment, is comprised of an inflatable ballistic shield device. The device is preferably comprised of at least three ballistic panels and an inflatable bladder. When not in use, the device can be stored in an uninflated, folded configuration. When in use, the bladder can be rapidly inflated, which unfolds the ballistic panels and forms the device into a rigid ballistic shield.

Referring initially to the drawings, FIG. 1 illustrates a front view of one potential embodiment of an inflatable ballistic shield device 100 of the present invention while inflated in accordance with the disclosed architecture. The device 100 is comprised of an inflatable ballistic shield with at least one inflatable bladder 110 and at least one shield ballistic insert 116. During use, the device 100 can be stored in an uninflated and folded state. Then, the device 100 can be rapidly inflated and unfolded (either manually or automatically via the inflation of the bladder) before deployment to form a ballistic shield.

The device 100 is comprised of a body 102 made from a fabric material. Said material may include but is not limited to a param-aramid synthetic fiber, polyethylene, ballistic nylon, Cordura, reinforced coated fabric (PVC), etc. The body 102 may be any shape and size that can preferably cover (but is not limited to) the upper body (and in one embodiment, the pelvic area) of a user.

The bladder 110 is located within the body 102. The bladder 110 is preferably a singular, flat bladder. However, in different embodiments the bladder 110 may be any size, style, and configuration of air bladder known in the art, including but not limited to a quilted bladder, a chambered bladder, or any bladder style incorporating multiple inflated cells. The bladder 110 is constructed using a plurality of tensile filaments/fibers. Once inflated, the filaments/fibers are placed in tension. This ensures that the bladder 110 will only be displaced in a limited and controlled manner when impacted with a projectile, and absorbs the force of the projectile impact and distributes the force of a projectile impact through the entire bladder 110.

The bladder 110 may be constructed of many different types of materials such as fabric-reinforced high-density polyurethane, polyvinyl chloride (PVC), plastic or any other suitable material types such as those used in children's bouncing jumpers. The material can be thin sheets such as 30 oz./yd$^2$ to 80 oz./yd$^2$ fabric weight, or any other suitable thickness or shape.

Figure 2:
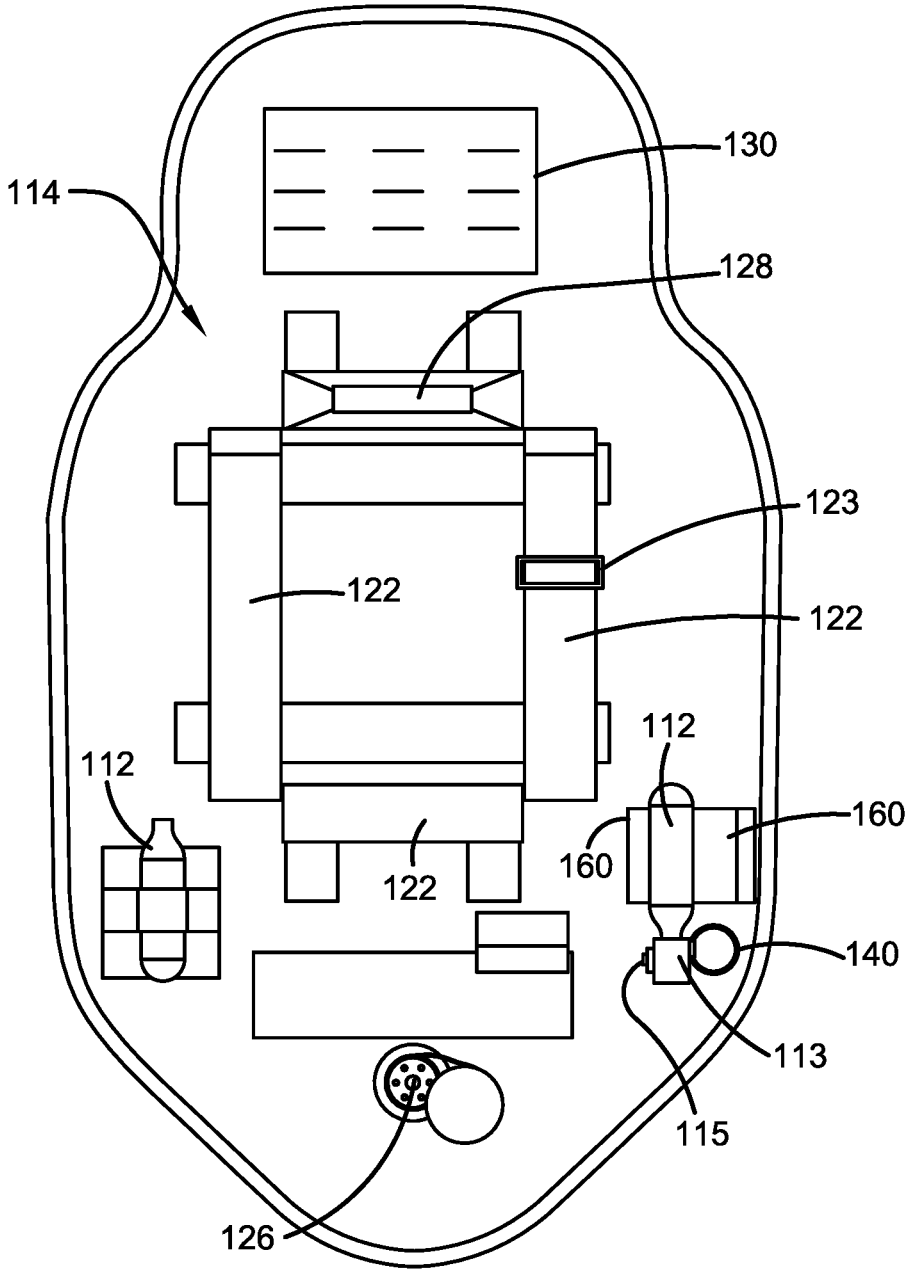
FIG. 2 illustrates a rear view of one potential embodiment of an inflatable ballistic shield device of the present invention while inflated in accordance with the disclosed architecture.

In one embodiment, the bladder 110 can be manually inflated with air via at least one valve 126 (of any valve type known in the art), as seen in FIG. 2. This valve 126 also allows for rapid manual deflation of the bladder 110. In another embodiment, the bladder 110 can be inflated via at least one canister 112. The canister 112 preferably contains a gas, such as but not limited to CO2. The canister 112 attaches to at least one valve 113, which attaches to the bladder 110 via at least one fastener flange 115 such as but not limited to a thermal welded interface, glued interface, pinched joint, gasket seal, etc. The canister 112 is comprised of at least one pull tab 140 or other similar control that allows a user to release the gas within the canister 112 into the bladder 110 via the valve 113. The canister 112 attaches to the rear surface 114 of the body 102 via at least one fastener 160 such as but not limited to a loop, a hook and loop strap, a magnet, etc. The bladder 110 is preferably inflated to 10 psi.

During the rapid inflation process, the body 102 unfolds and then can be attached to a user via at least one arm strap 122 located on the rear surface 114 of the body 102. The strap 122 is comprised of at least one fastener 123, such as but not limited to a hook and loop fastener, that allows the strap 122 to be tightened around a user's arm. It should be noted that once fastened around a user's arm, the user's arm contacts the rear surface 114, in contrast to existing ballistic shields wherein a user's arm is often cantilevered relative to the shield while in use. In this manner, the device 100 moves more like an extension of the user's body. In one embodiment, the strap 122 may be any style of attachment mechanism that allows the body 102 to attach to a body area of a user.

The rear surface 114 may also be comprised of at least one rigid handle 128 that is adjustable in size/placement and that allows the device 100 to be held/carried. The rear surface 114 may also be comprised of at least one MOLLE panel 130 for storage/attachment of various compatible items to the rear surface 114 and/or the front surface 117. Furthermore, the front surface 117 may be comprised of at least one fastener 142 that allows an item to attach to the front surface 117. The fastener 142 may include but is not limited to hook and loop, magnet, adhesive, clip, etc. which allows attachments such as but not limited to identification patches, lights, cameras, etc. to be attached to the front surface 117.

The body 102 is also comprised of at least one shield ballistic insert 116 that may be located within the body 102 and/or may be stitched to or enclosed by the body 102 (in a manner such that the panel 116 is separated from the bladder 110) in front of the bladder 110 (i.e., positioned such that the panel 116 is the first structure of the device 100 to absorb a projectile impact). The shield ballistic insert 116 may be made from materials such as but not limited to aramid, ultra-high molecular weight polyethylene fiber (UHMWPE), Kevlar, fiberglass, or any other soft or hard ballistic armor/panel material. In different embodiments, the panel 116 may offer NIJ Level IIA protection, NIJ Level II protection, NIJ Level IIIA protection, NIJ Level III protection, NIJ Level III+ protection, NIJ Level IV protection, etc. In one embodiment, any panel 150,152,154 may be comprised of at least one ballistic window 180 that may be from a form of polycarbonate or any other known ballistic window material known in the art. The window 180 allows a user to see through the panel 150,152,154 during use.

In the preferred embodiment, the device 100 has three shield ballistic inserts 116, which includes a large central panel 150, a top panel 152, and a bottom panel 154. In this embodiment, all or some of any area of the central panel 150 may overlap any area of the top 152 and bottom panels 154 for additional strength and to prevent puncturing of the bladder 110.

Figure 3:
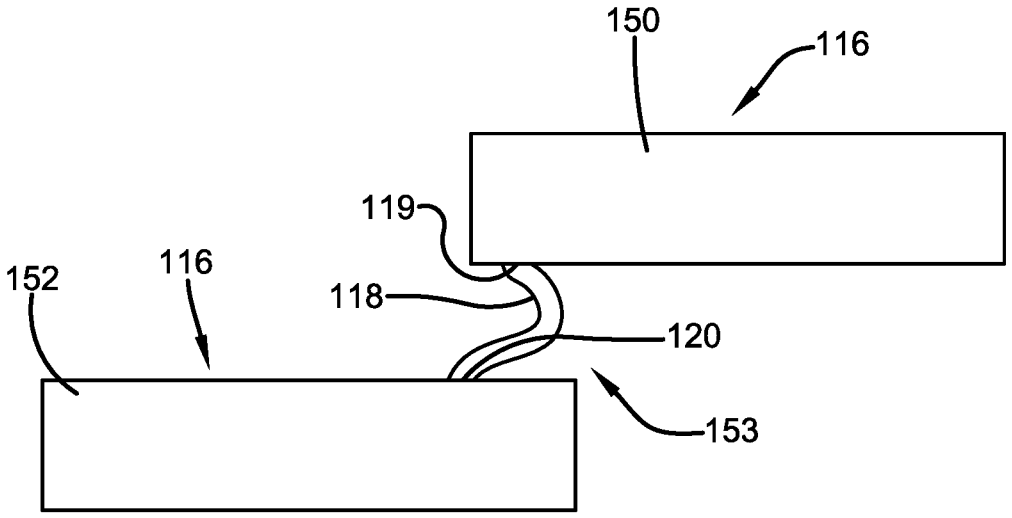
FIG. 3 illustrates a side view of a joint attaching the central panel to the top panel of one potential embodiment of an inflatable ballistic shield device of the present invention while inflated in accordance with the disclosed architecture.

In this embodiment, the top panel 152 and bottom panel 154 are each connected to the central panel 150 via at least one fabric joint 118 of the body 102, as seen in FIG. 3. More specifically, a first edge 119 of the joint 118 attaches to the central panel 150 and a second edge 120 of the joint 118 attaches to the panel 152,154. It should be noted that the configuration of the joint 118 ensures that a portion of the central panel 150 overlaps a portion of the top panel 152 and bottom panel 154 when the bladder 110 is fully inflated.

Figure 4:
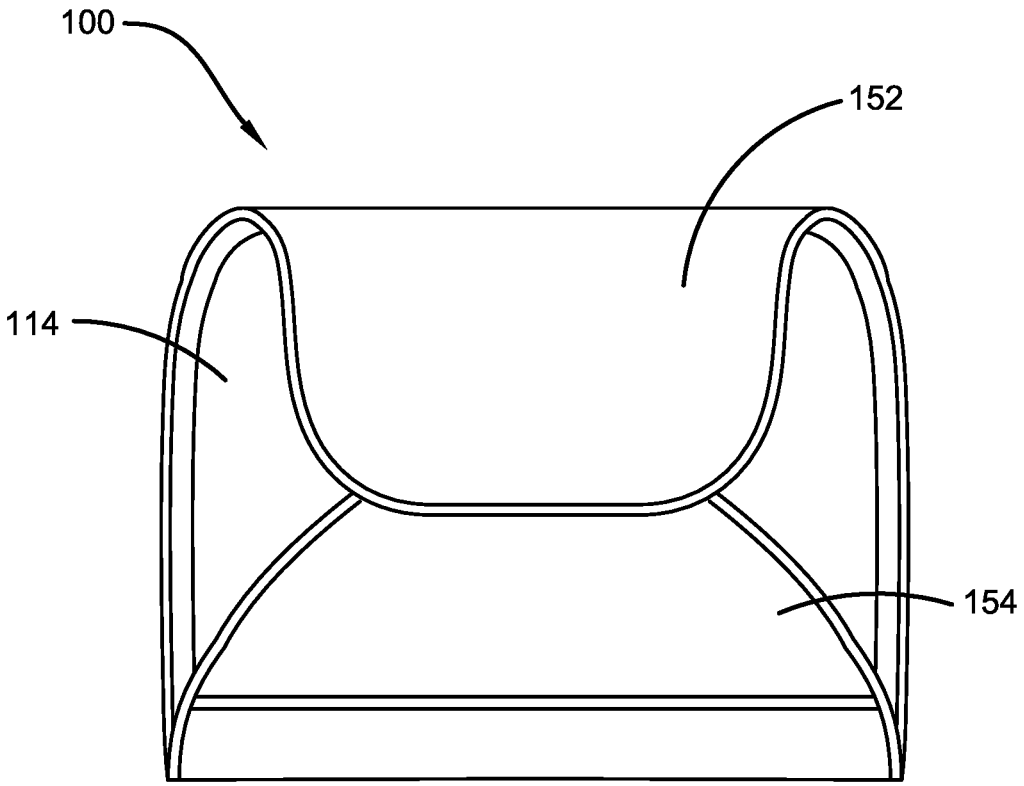
FIG. 4 illustrates a top view of one potential embodiment of an inflatable ballistic shield device of the present invention while uninflated and folded in accordance with the disclosed architecture.
Figure 7:
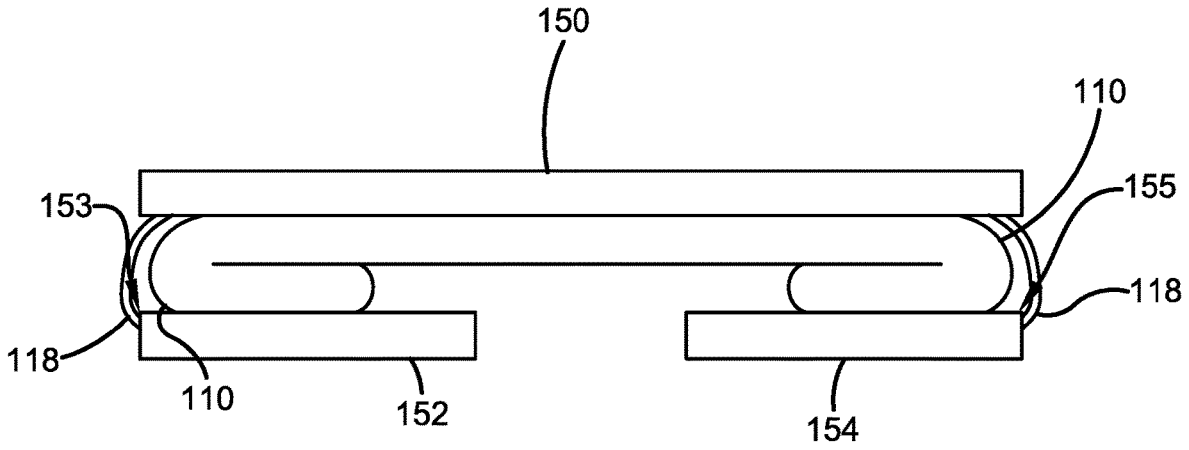
FIG. 7 illustrates a side view of one potential embodiment of an inflatable ballistic shield device of the present invention while folded and uninflated in accordance with the disclosed architecture.
Figure 8:
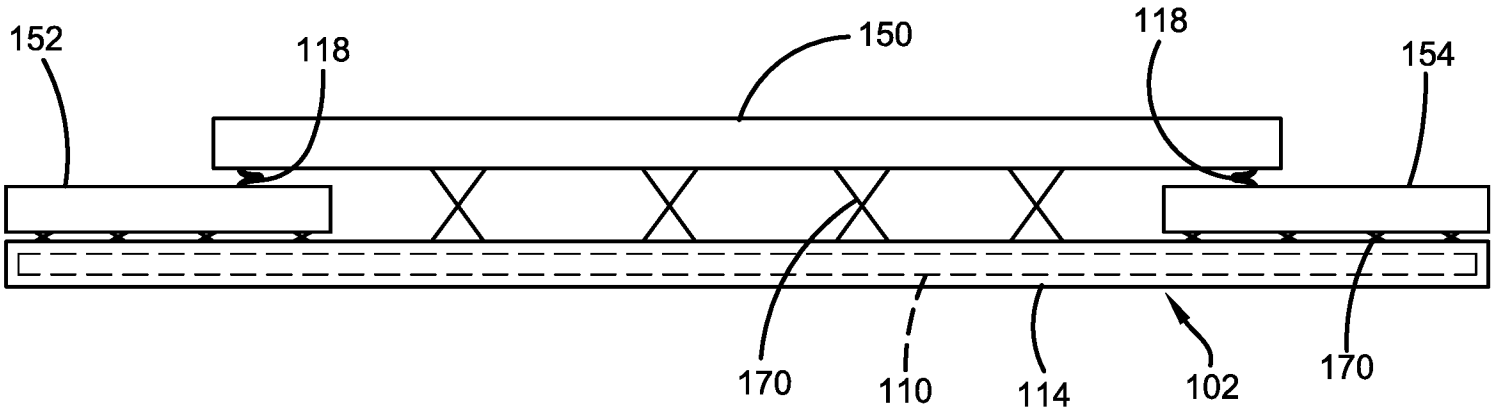
FIG. 8 illustrates a side view of one potential embodiment of an inflatable ballistic shield device of the present invention while unfolded and inflated in accordance with the disclosed architecture.

However, when the bladder 110 is not inflated, the joint 118 reverses and expands/moves upward, which allows the top panel 152 and bottom panel 154 to fold over the central panel 150, as seen in FIG. 7. In one embodiment, the panels 152,154 may be sized and dimensioned, along with the function of the joints 118 to allow the bottom panel 152 to overlap the top panel 152 when the device 100 is folded or vice versa, as seen in FIG. 4. More specifically, in this position each joint 118 folds around a corner 153,155 of the panels 152,154. Because each panel 150,152,154 is individually connected to the body 102 via at least one stitch 170 or other fastening method, inflation of the bladder 110 facilitates the unfolding of the panels 150,152,154 in the overlapping manner as seen in FIG. 8. Similarly, the individual attachment of each panel 150,152,154 to the body 102 and the attachment of each joint 118 ensures the top and bottom panels 152,154 fold over the central panel 150 when the bladder 110 is not inflated or is uninflated, as seen in FIG. 7. As a result, a user need not manually unfold the device 100 during use and can rely on the inflation of the bladder 110 and attachment of the panels 150,152,154 to the body 102 (and each other via the joint 118) to ensure proper folding/unfolding.

Figure 5:
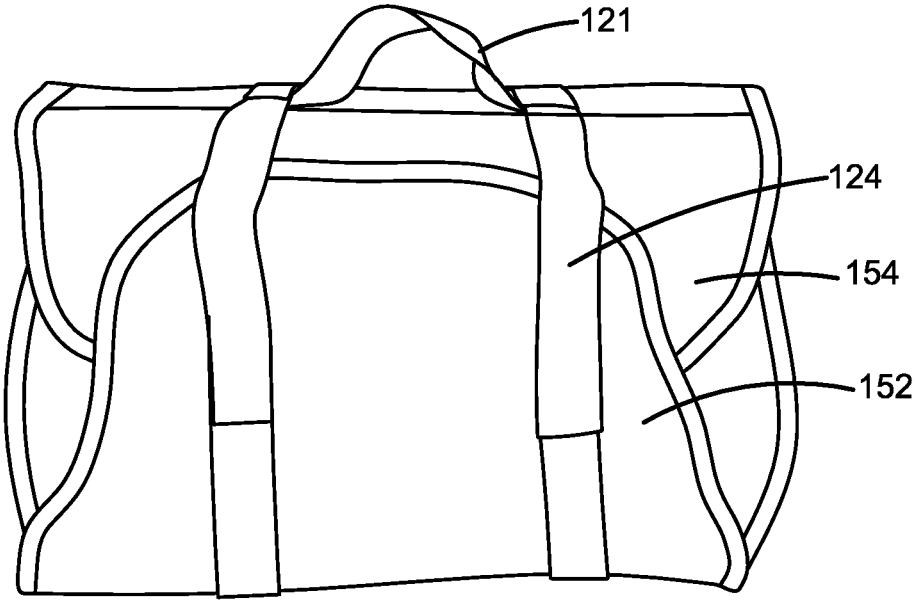
FIG. 5 illustrates a top view of one potential embodiment of an inflatable ballistic shield device of the present invention while uninflated, folded, and secured in accordance with the disclosed architecture.
Figure 6:
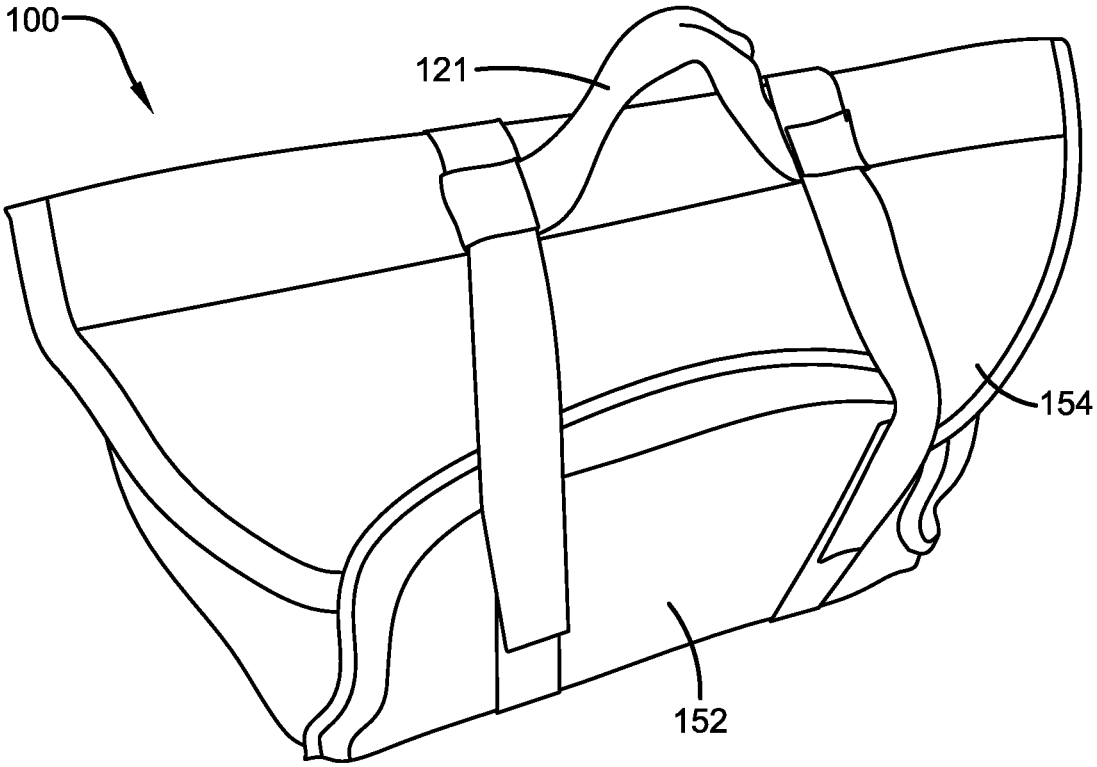
FIG. 6 illustrates a perspective view of one potential embodiment of an inflatable ballistic shield device of the present invention while uninflated, folded, and secured in accordance with the disclosed architecture.

Furthermore, when in an uninflated and folded state (as seen in FIG. 4) the device 100 forms a square-like shape that can be easily stored. When in a folded and uninflated configuration, the panels 150,152,154 surround and protect the bladder 110 and all structures of the rear surface 114. The device 100 can be secured in said shape via at least one strap 124 or other similar fastener that can be wrapped around the body 102, as seen in FIG. 5 and FIG. 6. In this undeployed, stored embodiment the device 100 can then be carried via at least one exterior handle 121.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "inflatable ballistic shield device" and "device" are interchangeable and refer to the inflatable ballistic shield device 100 of the present invention.

Notwithstanding the forgoing, the inflatable ballistic shield device 100 of the present invention and its various components can be of any suitable size and configuration as is known in the art without affecting the overall concept of the invention, provided that they accomplish the abovestated objectives. One of ordinary skill in the art will appreciate that the size, configuration, and material of the inflatable ballistic shield device 100 as shown in the FIGS. are for illustrative purposes only, and that many other sizes and shapes of the inflatable ballistic shield device 100 are well within the scope of the present disclosure. Although the dimensions of the inflatable ballistic shield device 100 are important design parameters for user convenience, the inflatable ballistic shield device 100 may be of any size, shape, and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An inflatable ballistic shield device comprising:
- a body comprised of a front surface and a rear surface comprised of a strap;
- a shield ballistic insert sandwiched within the body between the front and rear surfaces; and
- an inflatable bladder comprised of a valve; and
- wherein the bladder is sandwiched within the body between the front and rear surfaces and behind the shield ballistic insert; and
- wherein the front surface of the body comprises a magnetic fastener.

2. The inflatable ballistic shield device of claim 1, wherein the valve allows for inflation and deflation of the bladder.

3. The inflatable ballistic shield device of claim 1, wherein the bladder is comprised of a tensile fiber material.

4. The inflatable ballistic shield device of claim 1, wherein the body is comprised of a param-aramid synthetic fiber, a polyethylene, a ballistic nylon, or a reinforced coated fabric.

5. The inflatable ballistic shield device of claim 1, wherein the shield ballistic insert is comprised of an aramid, an ultra-high molecular weight polyethylene, or a fiberglass.

6. The inflatable ballistic shield device of claim 5, wherein the shield ballistic insert offers an NIJ Level IIA protection, an NIJ Level II protection, an NIJ Level IIIA protection, an NIJ Level III protection, an NIJ Level III+ protection, or a NIJ Level IV protection.

7. An inflatable ballistic shield device comprising:
- a body comprised of a front surface and a rear surface comprised of a strap;
- a shield ballistic insert comprising an upper panel, a middle panel, and a lower panel;
- a canister; and
- an inflatable bladder comprised of a valve; and
- wherein the shield ballistic insert is sandwiched within the body between the front and rear surfaces and positioned in front of the inflatable bladder;
- wherein the middle panel overlaps the upper and lower panels when the inflatable bladder is inflated; and
- wherein the upper and lower panels are each connected to the middle panel via a fabric joint.

8. The inflatable ballistic shield device of claim 7, wherein the canister contains a gas.

9. An inflatable ballistic shield device comprising:
- a body comprised of a front surface and a rear surface comprised of a strap;
- a shield ballistic insert comprising an upper panel, a middle panel, and a lower panel;
- a canister; and
- an inflatable bladder comprised of a canister inflation valve and a manual inflation and deflation valve, the canister inflation valve attached to the bladder via a fastener flange; and
- wherein the shield ballistic insert is sandwiched within the body between the front and rear surfaces and positioned in front of the inflatable bladder; and
- wherein the upper and lower panels are each connected to the middle panel via a fabric joint, wherein each fabric joint is configured to allow the middle panel to overlap the upper and lower panels when the inflatable bladder is inflated and to allow the upper and lower panels to fold over the middle panel when the inflatable bladder is deflated.

10. The inflatable ballistic shield device of claim 9, wherein the fastener flange is comprised of a thermal welded interface, glue interface, a pinched joint, or a gasket seal.

11. The inflatable ballistic shield device of claim 9, wherein the front surface is comprised of a fastener.

12. The inflatable ballistic shield device of claim 9, wherein the rear surface is comprised of a handle.

13. The inflatable ballistic shield device of claim 9, wherein the canister attaches to the rear surface via a second fastener.

14. The inflatable ballistic shield device of claim 9, comprised of a strap that secures the inflatable ballistic shield device in a folded configuration.

* * * * *